US008807289B2

(12) United States Patent
Bloch

(10) Patent No.: US 8,807,289 B2
(45) Date of Patent: Aug. 19, 2014

(54) ELEVATOR PIT BARRIER

(75) Inventor: Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 503 days.

(21) Appl. No.: 12/614,717

(22) Filed: Nov. 9, 2009

(65) Prior Publication Data

US 2010/0051392 A1 Mar. 4, 2010

Related U.S. Application Data

(62) Division of application No. 11/866,634, filed on Oct. 3, 2007, now abandoned.

(30) Foreign Application Priority Data

Oct. 6, 2006 (EP) ..... 06121879

(51) Int. Cl.
*B66B 13/28* (2006.01)
*B66B 5/28* (2006.01)

(52) U.S. Cl.
USPC ..... 187/414; 187/343; 187/351

(58) Field of Classification Search
CPC ..... B66B 5/005; B66B 5/056; B66B 5/025
USPC ..... 187/343–347, 401, 414, 351, 400
IPC ..... B66B 5/00, 5/02, 5/28, 11/02, 13/28
See application file for complete search history.

(56) References Cited

U.S. PATENT DOCUMENTS

| | | | | |
|---|---|---|---|---|
| 409,486 A | | 8/1889 | Nickerson | |
| 751,504 A | | 2/1904 | Hallock | |
| 1,614,675 A | | 1/1927 | Jones | |
| 4,091,906 A | * | 5/1978 | Clarke et al. | 192/129 A |
| 5,195,616 A | | 3/1993 | Yoo et al. | |
| 5,806,633 A | * | 9/1998 | Macuga | 187/357 |
| 6,202,797 B1 | * | 3/2001 | Skolnick et al. | 187/317 |
| 7,077,243 B2 | | 7/2006 | Huber et al. | |
| 7,249,656 B2 | | 7/2007 | Huber et al. | |
| 2006/0042883 A1 | * | 3/2006 | Scott | 187/351 |
| 2006/0201744 A1 | * | 9/2006 | Curtis et al. | 182/138 |

FOREIGN PATENT DOCUMENTS

| | | | | |
|---|---|---|---|---|
| DE | 100 52 459 A1 | | 5/2002 | |
| EP | 1 479 636 A | | 11/2004 | |
| EP | 2138443 A1 | * | 12/2009 | B66B 5/00 |
| JP | 09315720 A | * | 12/1997 | B66B 5/28 |
| JP | 2001240338 A | * | 9/2001 | B66B 5/28 |
| JP | 2004043177 A | * | 2/2004 | B66B 5/28 |
| WO | WO 2005/058739 A2 | | 6/2005 | |
| WO | WO 2006059174 A1 | * | 6/2006 | B66B 5/00 |

OTHER PUBLICATIONS

Machine Translation, DE 10052459 A1, EPO, Sep. 25, 2013, pp. 1-5.*

* cited by examiner

*Primary Examiner* — William A Rivera
*Assistant Examiner* — Stefan Kruer
(74) *Attorney, Agent, or Firm* — Ladas & Parry LLP

(57) ABSTRACT

An elevator installation includes a car within a shaft, a buffer mounted in a pit of the shaft and a barrier located in the pit surrounding or within an area wherein a vertical clearance between the pit floor and the car or equipment mounted thereon is less than a regulatory threshold value when the car fully compresses the buffer. The barrier acts to physically deter personnel within the pit from inadvertent presence in the area of reduced vertical clearance.

14 Claims, 4 Drawing Sheets

ELEVATOR PIT BARRIER

The present application is a divisional of application Ser. No. 11/866,634 filed Oct. 3, 2007 now abandoned. The present invention relates to elevators and, in particular, to a barrier located in an elevator to maintain the safety of personnel working in a pit of reduced depth.

BACKGROUND OF THE INVENTION

There are increasing pressures on the elevator industry to reduce the space occupied by elevator installations within buildings. One solution is to reduce the depth of the pit of the elevator shaft, however, regulations such as European Standard EN81-1:1998 specify that when an elevator car rests on its fully compressed buffers, there shall be a specified minimum free vertical clearance between the pit floor and the lowest parts of the car. There are exceptions to these rules, such as for toeguards, roller guides, guide shoes and safety gear, all of which are generally mounted on the outside periphery of the car. A common situation is depicted in FIGS. 1 to 3. In this example, the elevator car 1 is supported by means of an underslung pulley box 2 on ropes 4. The ropes 4 are driven by a traction sheave (not shown) to move the car 1 along guide rails (not shown) mounted to opposing shaft walls 6. A buffer 16 is mounted in the pit 12 of the shaft 10 to arrest the car 1 should it travel beyond its normal travel limit (e.g. the lowest landing). When the car 1 rests on the fully compressed buffer 16, as shown specifically in FIG. 3, a minimum free vertical clearance C exists between the pit floor 14 and the lowest part of the car 1, which in this instance is the pulley box 2. Although the toeguard 8 actually extends below the pulley box 2, as mentioned above, the regulations allow it to be excluded from consideration.

The objective of the present invention is to reduce the pit depth and thereby the minimum free vertical clearance between the pit floor and the lowest parts of the car while maintaining the safety of any personnel working in the pit.

BRIEF DESCRIPTION OF THE INVENTION

This objective is achieved by an elevator installation comprising a car within a shaft, a buffer mounted in a pit of the shaft and a barrier located in the pit surrounding or within an area wherein a vertical clearance between the pit floor and the car or equipment mounted thereon is less than a regulatory threshold value when the car fully compresses the buffer. Accordingly, the barrier acts to physically deter personnel within the pit from inadvertent presence in the area of reduced vertical clearance.

Preferably, the barrier is height-adjustable and biased to its highest position. Thus, the barrier can have a height greater than the reduced vertical clearance but will not be damaged if the car travels into it. Furthermore, even if a maintenance person were to get a hand, for example, trapped between the car and the barrier, the height-adjustability of barrier ensures that such entrapment will not cause personal injury.

The barrier may be flexible and preferably elastically deformable. Such a barrier may take the form of an inflated balloon.

Alternatively, the flexible and deformable barrier may comprise two flexible uprights interconnected by linkage means such as a net. Should the car descend into the barrier, the flexible uprights will automatically deform to a reduced height. Since this barrier contains no complicated moving parts it provides a relatively low cost solution.

Preferably, the flexible uprights are formed from doubled-over elements so that if the car descends into the barrier each upright deforms outwards in mutually opposing directions. Accordingly, the greater the deformation of the uprights, the greater the area effectively protected by the barrier.

Alternatively, the barrier may comprise a pair of channels each retaining at least one slider, and linkage means secured to and interconnecting the sliders of the opposing channels. Accordingly, if the car descends into the barrier, the linkage means and sliders moved downwards in the channels against the biasing force.

The linkage means may have the form of rigid bars, wires, belts or a net.

BRIEF DESCRIPTION OF THE DRAWINGS

The present invention is hereinafter described by way of specific examples with reference to the accompanying drawings in which.

DETAILED DESCRIPTION OF THE INVENTION

Figure 1:
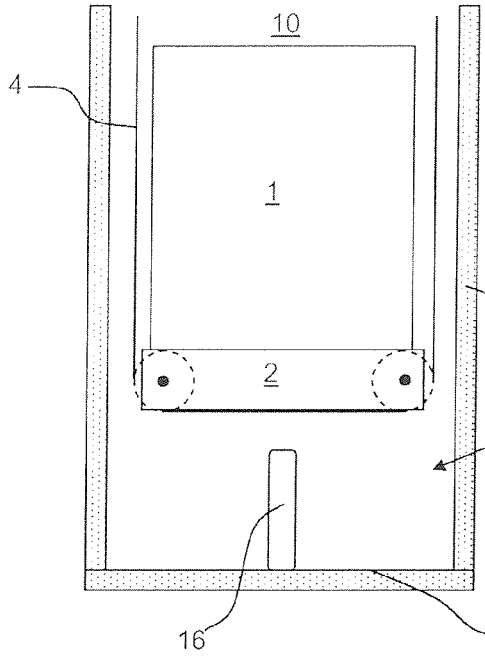
FIG. 1 (Prior art)
FIG. 1 is a partial, rear diagrammatic elevation view of a pit of an elevator installation according to the prior art.

In the following description, for the avoidance of unnecessary repetition, features of the invention which are common to more than one embodiment have been assigned a common reference numeral and where appropriate share a common description.

Figure 2:
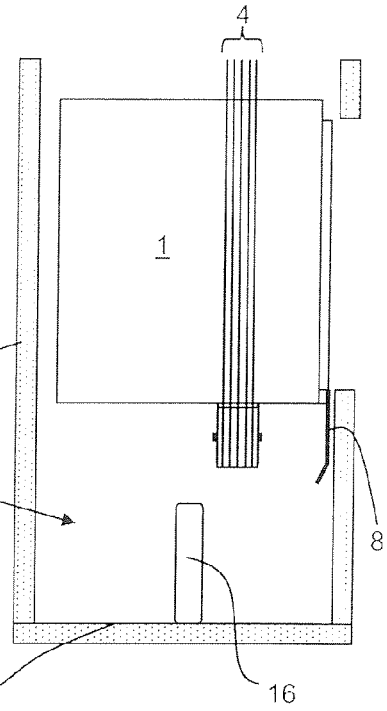
FIG. 2 (Prior art)
FIG. 2 is a partial, side diagrammatic elevation view of the pit of FIG. 1.
Figure 4:
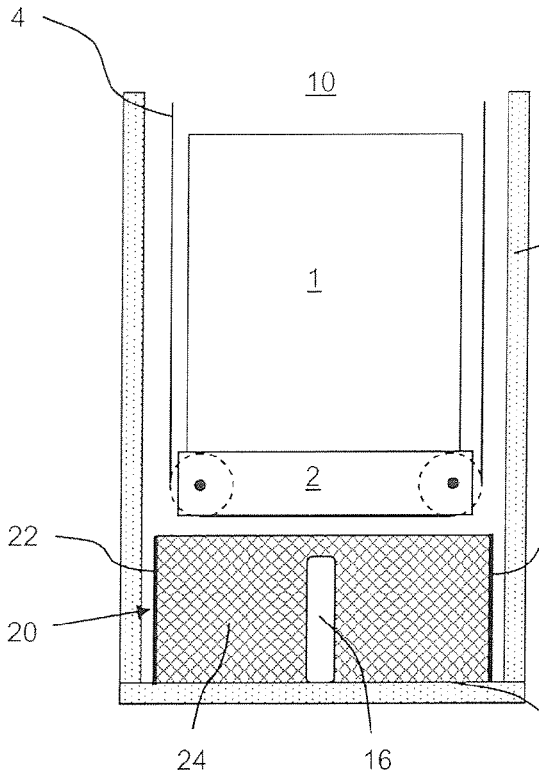
FIG. 4 is a partial, rear diagrammatic elevation view of a pit of an elevator installation in accordance with a first embodiment of the present invention.
Figure 5:
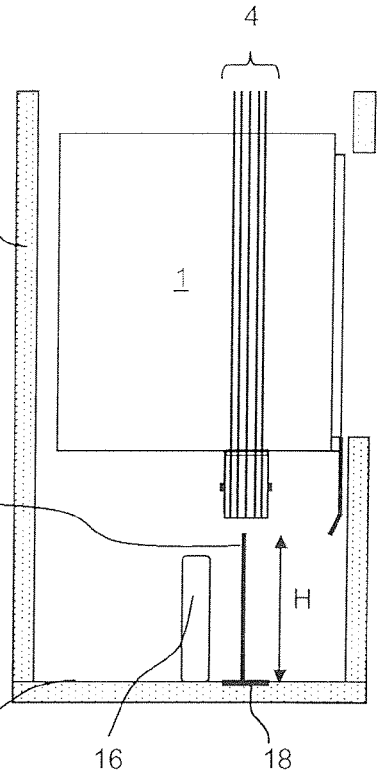
FIG. 5 is a partial, side elevation view of the pit of FIG. 4.

FIGS. 4 and 5 illustrate an elevator installation according to a first embodiment of the present invention. While the arrangements of the car 1 within the shaft 10 are identical to those previously described with respect to the prior art of FIGS. 1 and 2 respectively, areas on the pit floor 14 directly beneath the underslung pulley box 2 or other components mounted under the car are clearly designated as such as being marked with a tape 18 of diagonal stripes of contrasting colours (e.g. yellow and black or red and white). Preferably, words such as "DANGER LOW CLEARANCE" can be printed in the tape 18. Furthermore, a barrier 20 is also erected in the pit 12 directly beneath the underslung pulley box 2. The barrier 20 comprises a pair of opposing flexible uprights 22 mounted to the pit floor 14 with an interconnecting net 24. Accordingly, when maintenance personnel are in the pit 12, the tape 18 and the barrier 20 both act as visible warnings that the area under the pulley box 2 could potentially have a reduced vertical clearance. Moreover, the barrier 20 acts to physically deterrent personnel within the pit 12 from inadvertently working in the area of reduced vertical clearance.

If at any time the pulley box 2 should come into engagement with the barrier 20, the barrier 20 will be deflected due to the flexible nature of the uprights 22. Hence, even if a maintenance person were to get a hand, for example, trapped between the pulley box 2 and the barrier 20, the barrier is sufficiently flexible to accommodate the body part without causing damage.

Given the potential central location of the barrier 20 and the fact that it may essentially span the entire width of the pit 12, the maintenance personnel will inherently need to cross the barrier 20 occasionally; the barrier 20 is easily deformable to enable them to do so. However, these transitions across the barrier 20 make up only a small amount of the total time the maintenance personnel spend in the pit 12. The large majority of maintenance operations carried out in the pit 12 will actually typically require the person to face away from the barrier 20 which in turn generally means that their arms will also be projecting away from the barrier 20, in which case the person will only come into contact with the barrier if he backs into it; the normal reaction to that is to step slightly away and out of the reduced clearance area. Even the majority of work on a pulley box 2 is carried out from the side rather than underneath. Hence, a relatively low barrier, perhaps at knee height (≈500 mm), would be sufficient to effectively deter personnel from inadvertent presence in the area under the pulley box 2.

Figure 6:
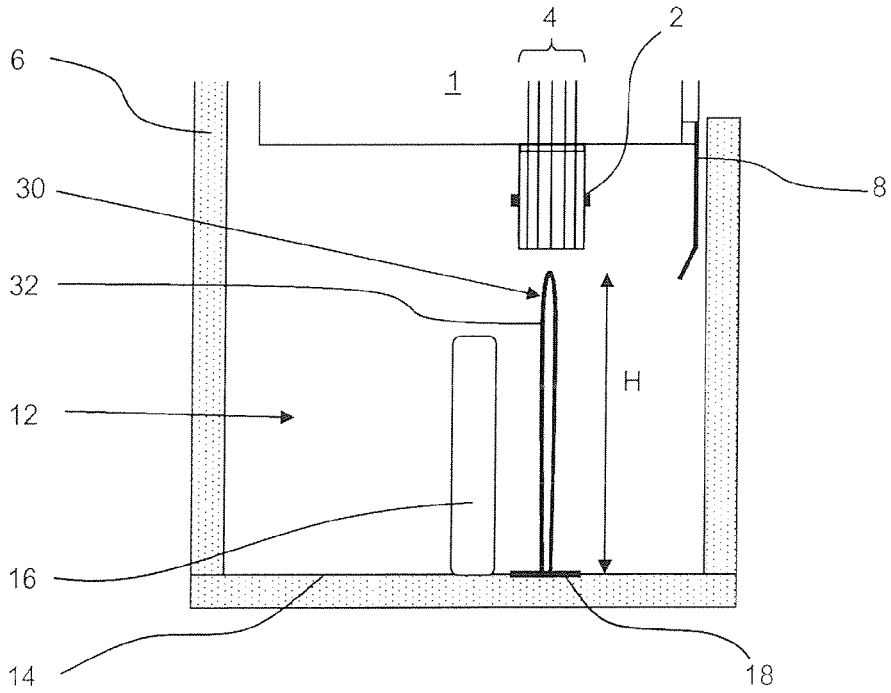
FIG. 6 is a partial, side elevation view of a pit of an elevator installation in accordance with a second embodiment of the present invention.
Figure 7:
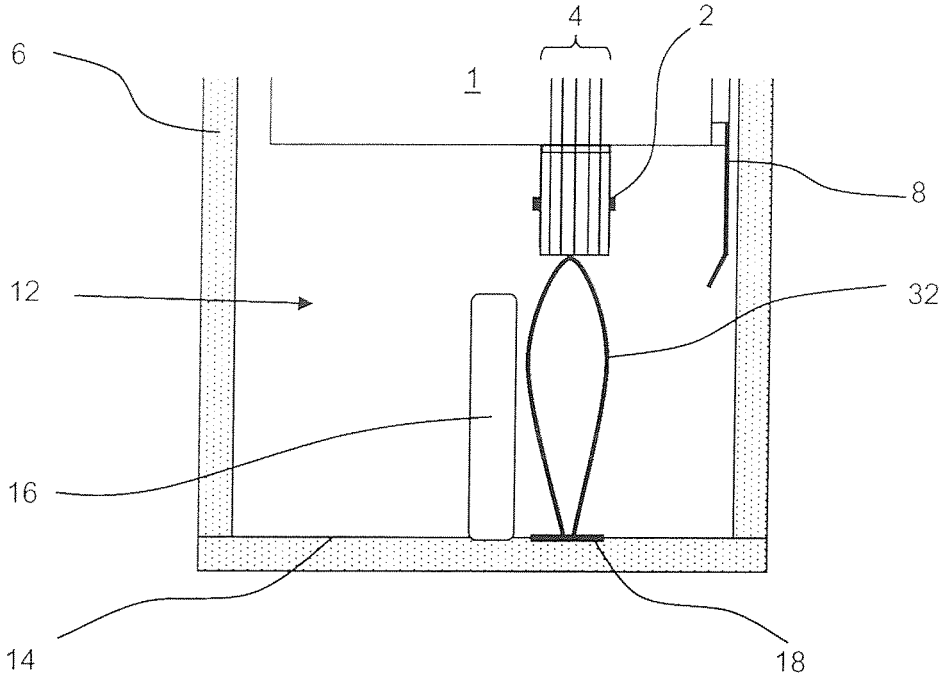
FIG. 7 is a view corresponding to FIG. 6 illustrating the elevator car engaging the barrier.
Figure 8:
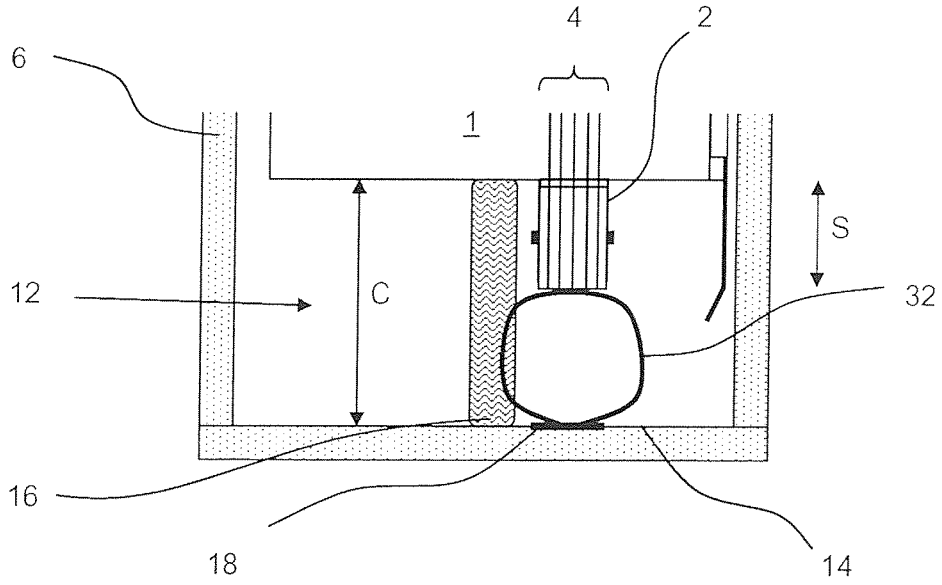
FIG. 8 is a view corresponding to FIG. 6 illustrating the elevator car compressing the buffer.

FIGS. 6 to 8 illustrate an alternative barrier 30 which is similar to the barrier 20 of the first embodiment but, in this instance, each of the uprights 32 is formed with a folded or doubled-over element with both ends secured to the pit floor 14. The doubled-over uprights may be sealed along the edges to form balloons. As shown specifically in FIG. 7, as the pulley box 2 descends upon the barrier 30, the doubled-over uprights 32 and the interconnected net 24 are deflected outwards. Accordingly, any person standing adjacent to the barrier 30 is also thrust away from the reduced clearance area under the pulley box 2. The car may continue to descend, and thereby further deform the barrier 30 until it rests on the fully compressed buffer 16, as shown in FIG. 8.

Figure 3:
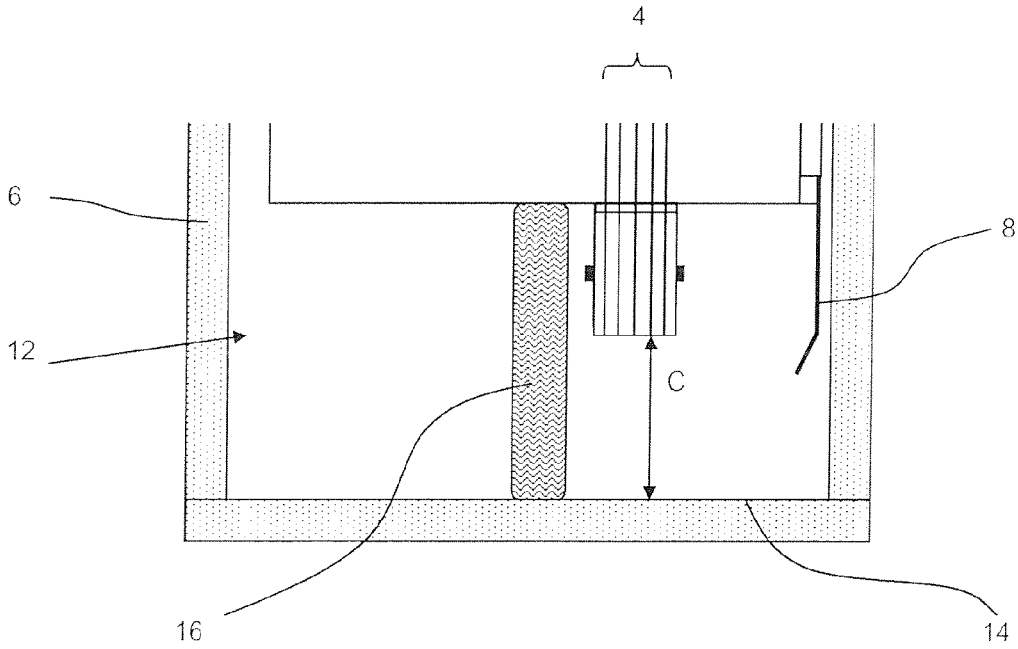
FIG. 3 (Prior art)
FIG. 3 is an elevation view corresponding to FIG. 2, illustrating the elevator car compressing the buffer.

Since the barriers 20, 30 of both embodiments effectively deter personnel from inadvertent presence in the area under the pulley box 2, the regulatory minimum free vertical clearance C may now be determined as existing between the pit floor 14 and the car 1, rather than between the pit floor 14 and the underslung pulley box 2 (as in the prior art of FIG. 3), enabling a space saving within the elevator installation corresponding to the height S of the pulley box 2.

Figure 9:
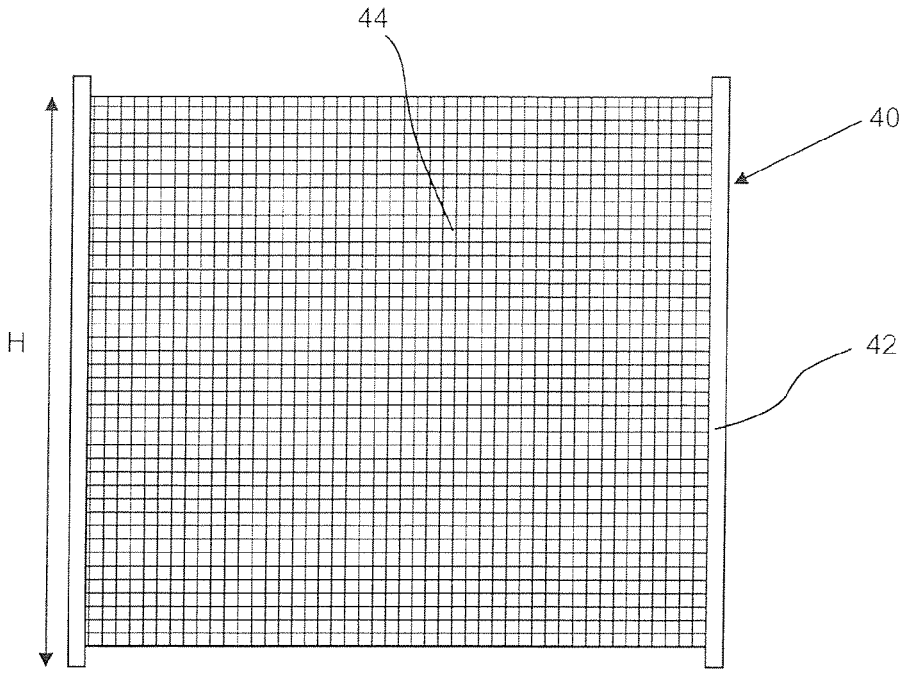
FIG. 9 is an elevation view of a barrier according to a third embodiment of the invention.
Figure 10:
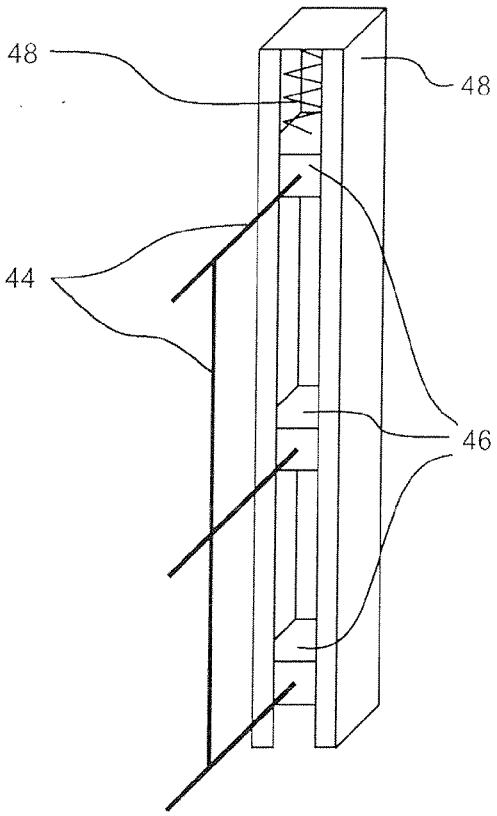
FIG. 10 is an exploded perspective view of the barrier of FIG. 9.

A further embodiment of the invention is illustrated in FIGS. 9 and 10. In this embodiment, the barrier 40 comprises a pair of opposing uprights in the form of U-shaped channels 42. The channels 42 may be secured at their bases to the pit floor 14 as in the previously described embodiments, or, alternatively, they can be mounted on opposing side walls 6 of the shaft 10. Each channel 42 retains a plurality of sliders 46 connected to a net 44. The uppermost slider 46 in each channel 42 is biased upwards by a spring 48.

If at any time the pulley box 2 descends into the net 44, the net 44 will descend therewith against the biasing force of the spring 48.

Figure 11:
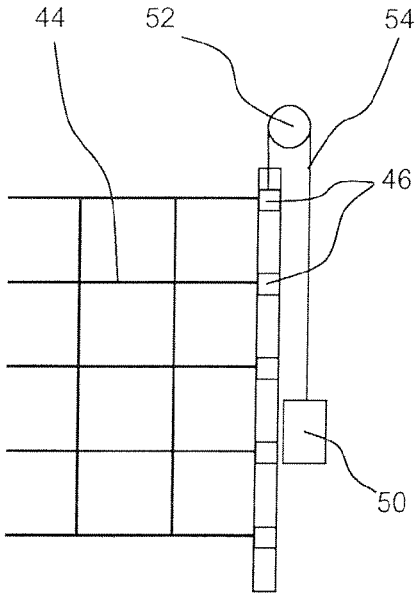
FIG. 11 is an illustrative sectional view of a barrier according to a fourth embodiment of the invention.

FIG. 11 shows another alternative embodiment of the invention, wherein the upward bias of the net 44 is provided by a counterweight 50. The uppermost slider 46 within each channel 42 is attached by a wire or rope 54, which passes over a pulley 52 to the counterweight 50.

Although all of embodiments above describe the use of a barrier under the underslung pulley box 2, it will be appreciated that the barrier can be used to deter personnel from inadvertent presence in any area of the pit 12 which has the possibility of reduced clearance.

As previously described, the area under the pulley box 2 is a relatively maintenance intensive area. If, on the other hand, the reduced clearance area is within a high maintenance intensive sector of the pit 12, then a relatively high barrier, perhaps at shoulder height (≈1500 mm), should be employed in or surrounding the reduced clearance area to positively prevent personnel from inadvertent presence in that area.

If the person needs to specifically work in a designated reduced clearance area, he can easily collapse the barrier to do so.

Although a net 24, 44 has been used in the preferred embodiments to interconnect the uprights 22,32 or the channels 48, will be readily appreciated that this can easily be replaced by other linkage means such as wires or rods.

I claim:

1. A method for restraining personnel on a pit floor in an elevator pit from entering from an adjacent pit floor area into an area of potentially reduced vertical clearance between the pit floor and a component mounted to an underside of an elevator car, comprising the steps of:

establishing a minimum required vertical clearance between the pit floor and the elevator car when a compressible buffer of a buffer system in the elevator pit is fully compressed by the elevator car and the car rests upon the buffer system above the pit floor;

determining a determined area of the pit floor below the component wherein a vertical clearance between the pit floor and the component is less than the minimum required vertical clearance when the compressible buffer is fully compressed by the car; and selectively erecting a barrier separate from the buffer system on the pit floor and extending upwardly therefrom at a location within or surrounding the determined area and spaced from the buffer system to physically deter personnel within the pit and in the adjacent pit floor area outside the determined area from inadvertently entering the determined area.

2. The method of claim 1 wherein the barrier is height-adjustable, further including a step of biasing the barrier to a highest position when erected.

3. The method of claim 2 wherein the erecting step includes locating the barrier at a location within the determined area that provides for contact between the barrier and the component.

4. The method of claim 3 wherein the barrier highest position is greater than the minimum required vertical clearance.

5. The method of claim 4 wherein the biasing permits the height of the barrier to be reduced by a force applied to the barrier by the component in a manner that mitigates injury to personnel, should said personnel become entrapped between the barrier and the component.

6. The method of claim 2 wherein the barrier highest position is greater than the minimum required vertical clearance.

7. The method of claim 6 wherein the biasing permits the height of the barrier to be reduced by a force applied to the barrier by the elevator car in a manner that mitigates injury to personnel, should said personnel become entrapped between the barrier and the elevator car.

8. The method of claim 2 wherein the barrier highest position is less than the minimum required vertical distance.

9. The method of claim 1 further including a step of deforming the barrier outwardly from the determined area upon contact of the barrier with the elevator car.

10. The method of claim 9 wherein the deformation step occurs in two mutually opposed directions.

11. The method of claim 9 wherein an extent of outward deformation is inversely proportional to a height of the component above the pit floor.

12. The method of claim 9 wherein a height of the barrier where deformation commences is chosen to be above the minimum required vertical clearance.

13. The method of claim 1 further comprising a step of providing a visual marker on the pit floor within the determined area.

14. The method of claim 13 wherein the marker is positioned in a plane of vertical travel of the component.

* * * * *